US009797143B2

(12) United States Patent
Luk

(10) Patent No.: US 9,797,143 B2
(45) Date of Patent: Oct. 24, 2017

(54) ARCHITECTURAL DECORATION PANEL DRY-HANG STRUCTURE FREE IN MOUNTING-DISMOUNTING AND FLEXIBLE IN SIZE COMBINATION

(71) Applicant: Sing Tan Andy Luk, Hong Kong (CN)

(72) Inventor: Sing Tan Andy Luk, Hong Kong (CN)

( * ) Notice: Subject to any disclaimer, the term of this patent is extended or adjusted under 35 U.S.C. 154(b) by 0 days.

(21) Appl. No.: 14/937,131

(22) Filed: Nov. 10, 2015

(65) Prior Publication Data

US 2017/0002571 A1 Jan. 5, 2017

(30) Foreign Application Priority Data

Jul. 3, 2015 (CN) ..... 201510388182
Sep. 21, 2015 (CN) ..... 201510604683

(51) Int. Cl.
*E04F 13/08* (2006.01)
*E04F 13/14* (2006.01)

(52) U.S. Cl.
CPC ..... *E04F 13/0816* (2013.01); *E04F 13/083* (2013.01); *E04F 13/0819* (2013.01); *E04F 13/0866* (2013.01); *E04F 13/14* (2013.01)

(58) Field of Classification Search
CPC . E04F 13/0816; E04F 13/0819; A47F 5/0846; A47B 95/008; A47B 97/001
(Continued)

(56) References Cited

U.S. PATENT DOCUMENTS 3,176,806 A * 4/1965 Ferrell ..... E04B 2/962 52/204.591
3,465,996 A * 9/1969 Von Wedel ..... E04B 2/94 248/287.1

(Continued)

FOREIGN PATENT DOCUMENTS

DE 19613439 A1 * 11/1996 ..... A47B 96/206
JP EP 1279776 A1 * 1/2003 ..... E04B 7/22

*Primary Examiner* — Charles A Fox
*Assistant Examiner* — Joseph J Sadlon
(74) *Attorney, Agent, or Firm* — Akeman LLP

(57) ABSTRACT

The present invention provides an architectural decoration panel dry-hang structure free in mounting-dismounting and flexible in size combination, wherein the architectural decoration panel dry-hang structure is provided with a vertical keel frame fixed on a wall surface, a transverse skeleton nut is disposed inside a vertical keel frame mounting groove on the vertical keel frame, the transverse skeleton nut is of a rectangle shape and has two opposite curved angles, a transverse skeleton is located outside the vertical keel frame, a transverse skeleton screw is screwed with the transverse skeleton nut after traversing the transverse skeleton, and the curved angles of the transverse skeleton nut lean against the side wall of the vertical keel frame mounting groove; and a coupling assembly disposed at the back of an architectural decoration panel component is inserted in a transverse skeleton mounting groove provided for the transverse skeleton so that the architectural decoration panel component is hung on the transverse skeleton. The present invention realizes high security, simple structure, convenient and quick mounting, environment protection and free of contamination of an architectural decoration panel mounting structure, and saving the cost.

9 Claims, 6 Drawing Sheets

(58) Field of Classification Search
USPC ... 52/483.1, 489.1, 764, 765, 766, 767, 768, 52/775; 211/87.01, 94.01; 248/287.1, 248/295.11, 297.21
See application file for complete search history.

(56) References Cited

U.S. PATENT DOCUMENTS 4,033,083 A * 7/1977 Fritz ..... E04B 9/26 52/357
4,979,344 A * 12/1990 Kusunoki ..... E04B 2/92 52/235
5,199,836 A * 4/1993 Gogarty ..... F16B 37/045 411/104
5,465,534 A * 11/1995 Mittag ..... E04F 15/02458 52/126.6
5,588,540 A * 12/1996 Schmit ..... A47B 95/008 211/187
5,718,493 A * 2/1998 Nikolai ..... A47B 95/008 312/245
5,961,082 A * 10/1999 Walter ..... A47F 5/0807 211/87.01
6,164,882 A * 12/2000 Selle ..... B60P 7/0815 410/2
6,712,568 B2 * 3/2004 Snyder ..... B60P 7/0815 410/102
6,748,709 B1 * 6/2004 Sherman ..... E04B 2/96 52/235
7,021,814 B2 * 4/2006 Berardi ..... F16B 37/045 248/222.11
8,365,481 B2 * 2/2013 Scully ..... E04F 13/0805 52/235
8,474,632 B2 * 7/2013 Yang ..... A47K 3/281 211/119.009
8,550,265 B2 * 10/2013 Botkin ..... A47B 96/067 211/106.01
8,991,781 B2 * 3/2015 Johnson ..... A47F 5/0006 211/41.1
9,079,534 B1 * 7/2015 Jaziri ..... B60R 9/02
9,615,677 B2 * 4/2017 Trinh ..... A47F 5/0087
9,677,268 B2 * 6/2017 Knight ..... E04B 2/562
2015/0300017 A1 * 10/2015 Carolan ..... E04B 2/721 52/483.1

* cited by examiner

ARCHITECTURAL DECORATION PANEL DRY-HANG STRUCTURE FREE IN MOUNTING-DISMOUNTING AND FLEXIBLE IN SIZE COMBINATION

TECHNICAL FIELD

The present invention relates to an architectural decoration panel dry-hang structure, and more particularly, to an architectural decoration panel dry-hang structure free in mounting-dismounting and flexible in size combination.

BACKGROUND

An architectural decoration panel refers to a platy structure or a structure having shapes, such as stones, woods, fire shutters, polyethylene materials, aluminum materials, ceramic tiles, glass, glass products, metal and nonmetal fire-proof building materials, and metal and nonmetal building materials or the like, which can be mounted on such surfaces like the external facade, internal facade, ceiling and floor of a building wall surface.

Conventional methods for mounting architectural decoration panel include a wet overlaying method, a sticking method and a dry-hang method. The conventional wet overlaying method uses cement mortar as an adhesive to glue an architectural decoration panel on a wall surface, however, the density of the architectural decoration panel itself is larger, which results in a larger mass ratio, while the wet overlaying mainly depends on the adhesive force of the cement mortar. If the adhesive force of the cement mortar is insufficient, it's easy to cause the architectural decoration panel to fall off. Moreover, alkali components contained in the cement tend to cause a salt-petering on the surface of the architectural decoration panel, while the wet overlaid architectural decoration panel and a wall body are in a rigid joint, which leads to a poor antiknock performance. The sticking method uses a special architectural decoration panel adhesive to glue an architectural decoration panel on a wall surface, which requires high flatness and cleanness of the wall surface, but the area and the thickness of the architectural decoration panel used are limited, and the architectural decoration panel is easy to break in case of being impacted, further, the architectural decoration panel adhesive remains on the surface of the architectural decoration panel and easily makes the interior of the architectural decoration panel loose due to aging effect of the adhesive, so that the surface is easy to fall off, thus quickening the aging of the architectural decoration panel. The conventional dry-hang method directly hangs an architectural decoration panel on a wall surface or suspends and hangs the architectural decoration panel on a steel frame, using a metal hanging piece, which is sophisticated in structure, having a higher requirement on the thickness of the architectural decoration panel (generally no less than 15 mm), and having big loss during grooving, moreover, mounting of the steel frame keel increases the load-bearing of the construction, which leads to difficulty in construction, high cost, long construction period, difficulty in dismounting after being mounted on the wall, and the architectural decoration panel cannot be repeatedly utilized. It is ideal to make the mounting of the architectural decoration panel safe, simple, convenient and quick, environment friendly, contamination free, and cost saving.

SUMMARY

The present invention provides an architectural decoration panel dry-hang structure free in mounting-dismounting and flexible in size combination, which aims at solving the defects of the prior art, and makes the mounting of the architectural decoration panel safe, simple, convenient and quick, environment friendly, contamination free, and cost saving.

To solve the technical problems, the present invention employs a technical solution as follows.

An architectural decoration panel dry-hang structure free in mounting-dismounting and flexible in size combination is provided with a vertical keel frame fixed on a wall surface, a transverse skeleton nut disposed inside a mounting groove on the vertical keel frame, the transverse skeleton nut is of a rectangle shape and has two opposite curved angles, a transverse skeleton is located on the outside of the vertical keel frame, a transverse skeleton screw is screwed with the transverse skeleton nut after traversing the transverse skeleton, and curved angles of the transverse skeleton nut lean against the side wall of the vertical keel frame mounting groove; and a coupling assembly disposed at the back of an architectural decoration panel component is inserted in a transverse skeleton mounting groove provided for the transverse skeleton, so that the architectural decoration panel component is hung on the transverse skeleton.

The transverse skeleton mounting groove is a groove which is opened outward, and after the coupling assembly is inserted into the transverse skeleton mounting groove, a friction face on the surface of the coupling assembly tightly leans against a friction face on the side wall of the transverse skeleton mounting groove.

Both the friction face on the surface of the coupling assembly and the friction face on the side wall of the transverse skeleton mounting groove are transverse strip-shaped threaded form structures.

The architectural decoration panel component comprises an architectural decoration panel, a composite material backing layer adhered to the architectural decoration panel, and the coupling assembly fixed on the composite material backing layer.

The composite material backing layer is provided with two chutes, two mounting plates of the coupling assembly are tightly inserted in the chutes so that the coupling assembly is fixed on the composite material backing layer.

The composite material backing layer is provided with a mounting groove, the mounting groove is provided with two parallel mounting faces, and the coupling assembly is tightly inserted in the mounting groove so that the coupling assembly is fixed on the composite material backing layer.

A part of the coupling assembly coupled with the architectural decoration panel and a part of the coupling assembly coupled with the transverse skeleton mounting groove may be coupled in a relatively sliding manner in a form of clamping strip and clamping groove.

A part of the coupling assembly coupled with the architectural decoration panel and a part of the coupling assembly coupled with the transverse skeleton mounting groove may be coupled in a relatively rotating manner in a form of rotating shaft.

Two parallel vertical keel frame mounting grooves are disposed on the vertical keel frame, and are corresponding to the transverse skeletons mounted at the two sides of the vertical keel frame respectively.

A single groove type of vertical keel frame mounting groove may also be disposed on the vertical keel frame for auxiliary enhancement.

The transverse skeleton screw traverses from the bottom of the transverse skeleton mounting groove so as to be screwed with the transverse skeleton nut.

The present invention has the advantages of:

1. Composite of the architectural decoration panel and the composite material backing may improve the utilization ratio of the architectural decoration panel, reduce loss, and lighten the entire mass; and using an aluminum skeleton with matched intensity may lighten the load-bearing of the wall body of the construction, and enhance safety and stability;

2. Using the aluminum skeleton as a floor frame can be free of affecting from the flatness of the wall surface; and free of contamination to the architectural decoration panel caused by chemical adhesive;

3. The structure is simple, the construction and mounting of which is convenient and quick, which can be operated by non-professional personnel, thus effectively reducing time cost and human cost;

4. The dismountable structure not only enables replacement of different styles of architectural decoration panels, but also enables the dismounted architectural decoration panel to be repeatedly utilized, thus realizing the recycling of resources, and being complied with the concept of environmental protection. The present invention is novel, safe, effective, low cost, implementing a green mounting process, environment-friendly and economical, and suitable for various indoor and outdoor decoration users to use widely;

5. A structure of using a screw for fixation in the groove is convenient to move the vertical keel frame and the transverse skeleton, and architectural decoration panels with different sizes may be selected freely for dry-hang after combination;

6. The present invention not only can be used as an architectural decoration panel dry-hang structure, but also can be used as a dry-hang structure of various materials for a construction wall surface.

BRIEF DESCRIPTION OF THE DRAWINGS

The present invention will be further described in details hereinafter with reference to the drawings and embodiments, wherein

FIG. 5-1 is a side view of a first example of coupling assembly;

FIG. 5-2 is a D-direction view of FIG. 5-1;

FIG. 6-1 is a side view of a second example of coupling assembly;

FIG. 6-2 is an E-direction view of FIG. 6-1;

FIG. 7-1 is a side view of a third example of coupling assembly;

FIG. 7-2 is an F-direction view of FIG. 7-1;

FIG. 7-3 is a G-G cross-sectional view of FIG. 7-1;

FIG. 8-1 is a side view of a first form of a fourth example of coupling assembly;

FIG. 8-2 is a side view of a second form of the fourth example of coupling assembly; and FIG. 8-3 is a side view of a third form of the fourth example of coupling assembly.

DETAILED DESCRIPTION

A most common slab-type stone plate is used as an embodiment hereinafter.

Figure 1:
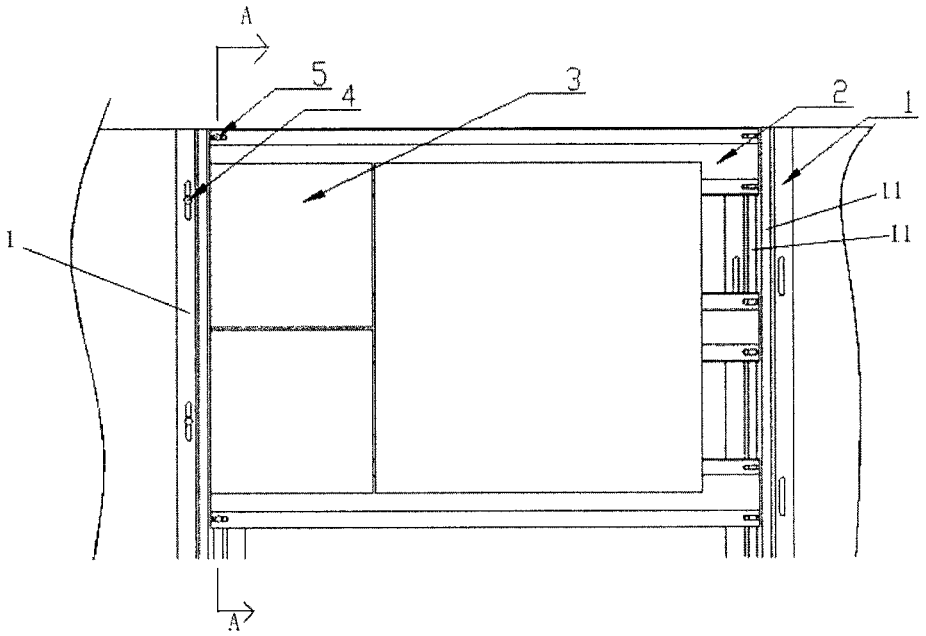
FIG. 1 is a structural view of the present invention.

As shown in FIG. 1, a vertical keel frame 1 is an aluminum alloy double-groove construction, i.e., the vertical keel frame 1 is provided two parallel vertical keel frame mounting grooves 11, which are corresponding to transverse skeletons 2 mounted at the two sides of the vertical keel frame 1. A pedestal and the top of the vertical keel frame 1 have holes reserved for bolts and screws, and are vertically nailed on a wall surface vertical to a ground surface through a screw 4 of the vertical keel frame; and the vertical keel frame 1 on the wall surface and the vertical keel frame 1 are precisely mounted in parallel by using a professional mounting fixture.

More vertical keel frames 1 may be disposed; and a single-groove type of vertical keel frame mounting groove 11 is disposed on the vertical keel frame 1 for auxiliary enhancement.

Figure 2:
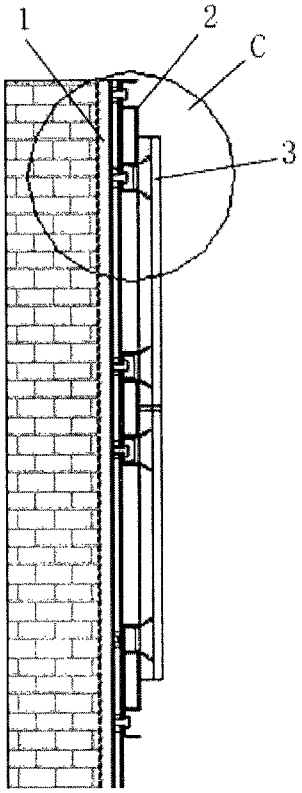
FIG. 2 is an A-A cross-sectional view of the present invention.
Figure 3:
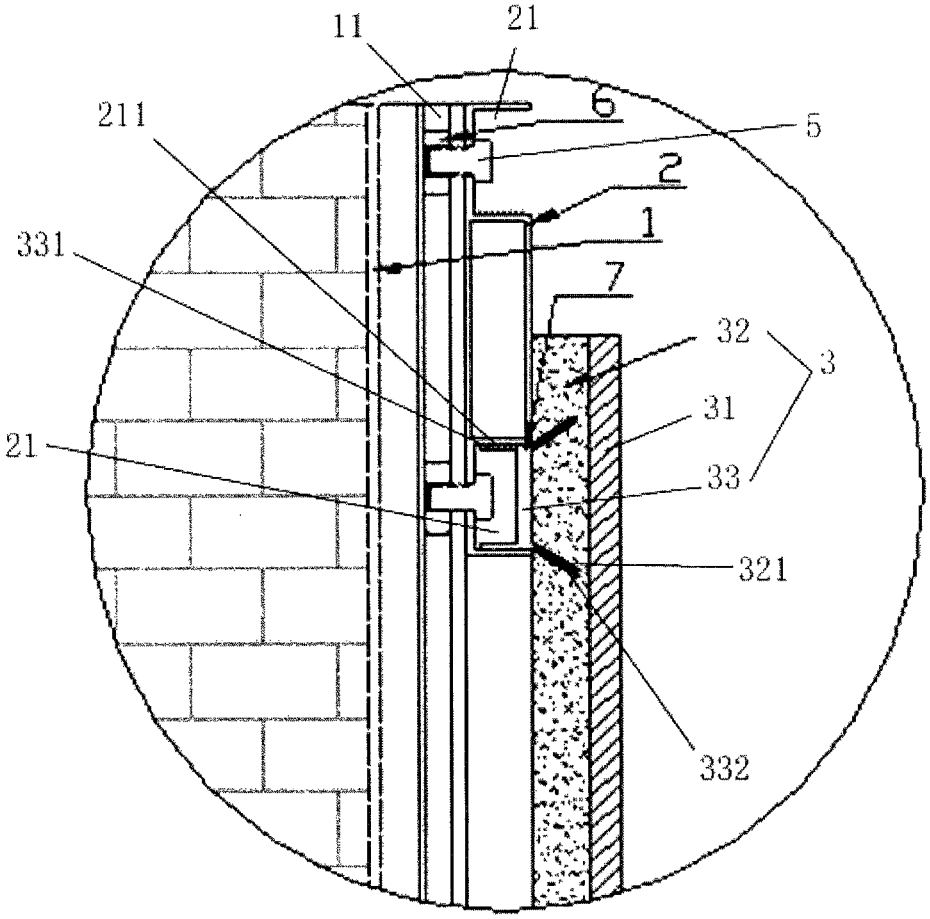
FIG. 3 is a partial enlarged view of portion C of FIG. 2.
Figure 4:
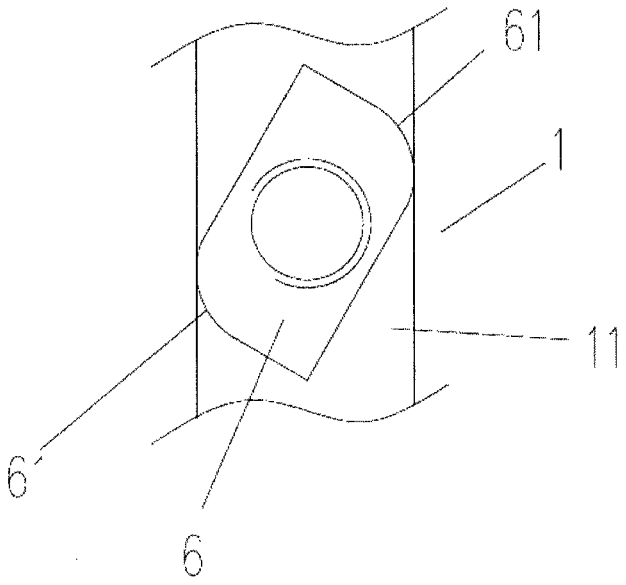
FIG. 4 is a schematic view of matching between a transverse skeleton nut 6 and a vertical keel frame mounting groove.

As shown in FIG. 4, a transverse skeleton nut 6 is of a rectangle shape and has two opposite curved angles 61, the transverse skeleton nut 6 is disposed in the vertical keel frame mounting groove 11, then the transverse skeleton 2 is disposed on the outside of the vertical keel frame 1. As shown in FIG. 2 and FIG. 3, the transverse skeleton 2 has a concave double-groove structure, i.e., the transverse skeleton 2 has two parallel transverse skeleton mounting grooves 21 which are opened outward, a transverse skeleton screw 5 traverses from the bottom of the transverse skeleton mounting groove 21 so as to be screwed with the transverse skeleton nut 6; the transverse skeleton screw 5 rotates to drive the transverse skeleton nut 6 to rotate, and finally makes the curved angles 61 of the transverse skeleton nut 6 tightly lean against the side wall of the vertical keel frame mounting groove 11; in this way, the transverse skeleton 2 produces a larger frictional force and a larger supporting force to the vertical keel frame mounting grove 11, through the screwing pressure of the transverse skeleton screw 5 to the transverse skeleton nut 6, so that the transverse skeleton 2 is horizontally hung on the vertical keel frame 1. Before screwing, the transverse skeleton nut 6 may vertically move up and down in the vertical keel frame mounting groove 11, thus it's adapting to stone materials of different sizes.

A stone component 3 is composed of a stone 31, a glass magnesium composite material backing layer 32 and a coupling assembly 33, wherein the stone 31 with high mass and high cost and the high-fibre glass magnesium composite material backing layer 32 with low density and high intensity are glued into a composite material by using glue; the composite material is an rectangle with standardized size and a side length of x−2; the length and widths of other specifications are all n*x−2, wherein n is an integral number. Two chutes 321 are processed in the glass magnesium composite material backing layer 32, wherein the two chutes 321 form a splay groove, the two mounting plates 332 of the coupling assembly 33 are tightly inserted in the chutes 321 so that the coupling assembly 33 is fixed on the composite material backing layer 32. The outer wall of the other end of the coupling assembly has a transverse strip-shaped threaded structure 331 served as a friction face.

The coupling assembly 33 has multiple forms.

Figures 1, 5:
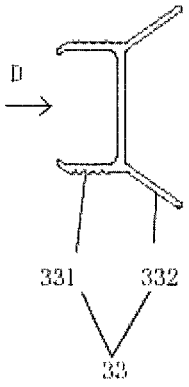
Figures 2, 5:
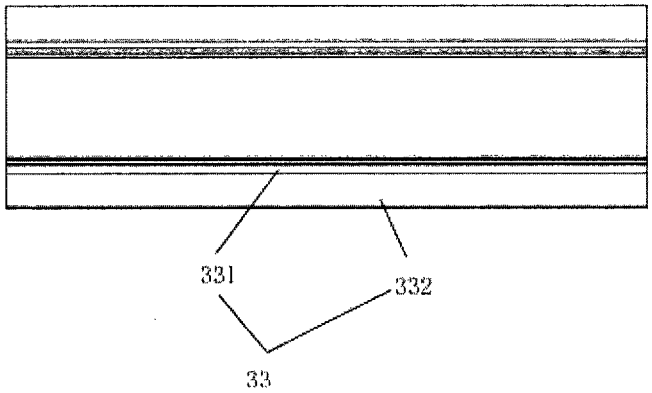

The first example of coupling assembly 33 is as shown in FIG. 5-1 and FIG. 5-2.

A standard fixation form of the two mounting plates 332 of the coupling assembly 33 and one end thereof having a transverse strip-shaped threaded form structure 331 are integrally formed profiles; therefore, such example of coupling assembly 33 is nonadjustable.

Figures 1, 6:
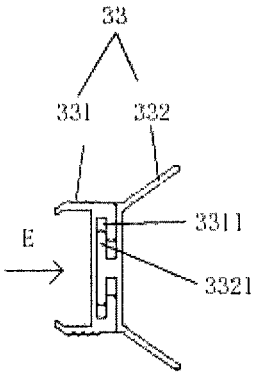
Figures 2, 6:
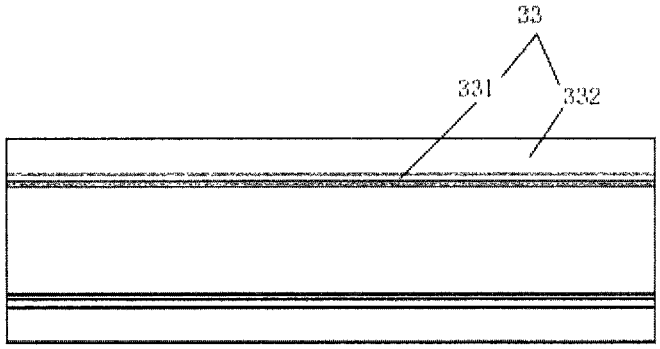
Figures 1, 7:
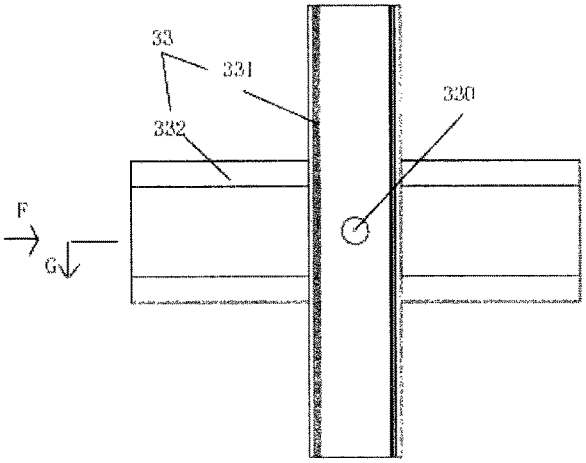
Figures 2, 7:
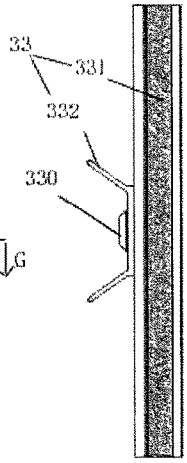
Figures 3, 7:
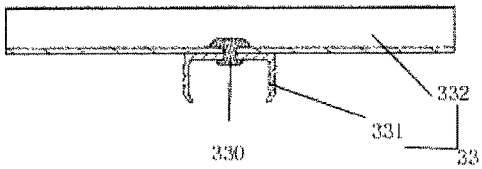

The second example of coupling assembly 33 is as shown in FIG. 6-1 and FIG. 6-2.

A fixed fine-adjustment form of a clamping strip 3321 disposed on a part of the coupling assembly 33 having the two mounting plates 332 may be slidably embedded in a clamping groove 3311 disposed at the end of the coupling assembly 33 having a transverse strip-shaped threaded form structure 331; in this way, the fine-adjustment of the mounting position of the stone component 3 may be implemented through the relative fine-adjustment sliding of the clamping strip 3321 in the clamping strip 3311.

The third example of coupling assembly 33 is as shown in FIG. 7-1, FIG. 7-2 and FIG. 7-3.

A fine-adjustment steering form of the coupling assembly 33 has a part having the two mounting plates 332, and an end having the transverse strip-shaped threaded form structure 331, this part and this end are coupled by a rivet or a bolt 330; in this way, the part of the coupling assembly 33 having the two mounting plates 332 and the end thereof having the transverse strip-shaped threaded form structure 331 may rotate relative to each other, thus implementing more flexible and diverse mounting forms of the stone component.

The fourth example of coupling assembly 33 is as shown in FIG. 8-1, FIG. 8-2 and FIG. 8-3.

Figures 1, 8:
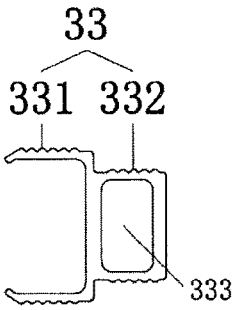
Figures 2, 8:
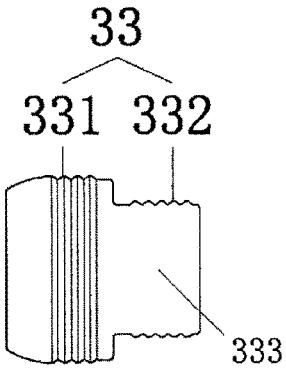
Figures 3, 8:
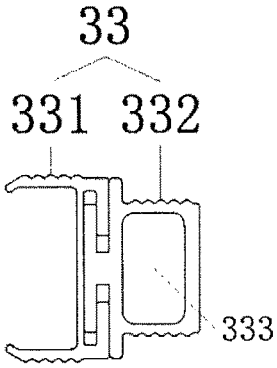

As shown in FIG. 8-1, a fixed form of the coupling assembly 33 has an end having a hollow frame 333 (or a solid frame), and another end having the transverse strip-shaped threaded form structure 331, such coupling assembly 33 is an integrally formed profile; therefore, the coupling assembly 33 is nonadjustable. The two sides of the hollow frame 333 are the two mounting plates 332, and the difference between the two mounting plates and the present splay mounting plates lies in that the outer surfaces of the two mounting plates 332 are parallel mounting faces.

The top ends of the two mounting plates 332 are connected, to form the hollow frame 333; in order to be matched with this structure, an elongated recess-form mounting groove may be disposed on the composite material backing layer 32, the two side walls of the mounting groove are two parallel mounting faces, in which the hollow frame 333 is tightly inserted.

In this way, the coupling assembly 33 is fixed on the composite material backing layer 32; in order to enhance the binding force of the two, additive, cement or the like may be added at the composition plane of the two.

A transverse strip-shaped threaded form structure may be disposed on the surface of the mounting plate 332 to increase a frictional force with the composite material backing layer, for a more stable coupling; and a transverse strip-shaped threaded form structure may also be accordingly disposed on the composite material backing layer.

This structure is simpler than the form of disposing two single mounting grooves in processing and mounting, since only an elongated recess is needed to be disposed on the composite material backing layer 32.

As shown in FIG. 8-2, the coupling assembly 33 has one end having a hollow frame 333, and another end having a transverse strip-shaped threaded form structure 331, wherein the one end and the another end are integrated; and the another end having the transverse strip-shaped threaded form structure 331 can be solid, thus the coupling assembly 33 is more stable and having high intensity.

In another embodiment, alternatively, the top ends of the two mounting plates 332 are not connected; in this way, two single parallel mounting grooves are disposed on the composite material backing layer 32 for inserting the two parallel mounting plates 332.

In a further embodiment, as shown in FIG. 8-3, one end having the hollow frame 333 (or solid frame) and another end having the transverse strip-shaped threaded form structure 331 can be designed similarly to the second example, or can be designed similarly to the third example of coupling assembly, which is designed to combine two relatively independent parts so that the fine-adjustment of the mounting position of the stone component 3 is implemented through sliding or rotating.

As shown in FIG. 1, FIG. 2 and FIG. 3, the inner wall of the transverse skeleton mounting groove 31 has a transverse strip-shaped threaded form structure 211 served as a friction face, the coupling assembly 33 is inserted into the transverse skeleton mounting groove 21 via a manner of minimum interference fit, the transverse strip-shaped threaded form structure 211 and the transverse strip-shaped threaded form structure 331 tightly lean against each other and are mutually engaged, so that the stone component 3 is fixedly coupled to and hung on the transverse skeleton 2.

The embodiment is composed of three blocks including a vertical metal keel frame, a transverse metal skeleton and a stone-glass-magnesium composite material which are combined through bolt, screw and frictional force. According to the structure, the stone may be optionally fixed on indoor walls or outdoor walls, the composition of the stone with glass and magnesium lightens the weight of the stone by 2.5 times, which not only lightens the load-bearing of the construction wall body, being more fireproof, more damp-proof, safer and more stable, but also can effectively increase the utilization ratio of the stone. A frictional force principle is utilized in the present invention to dry-hang the stone, which is simple, convenient and quick to mount, saving charges for labor of construction services, without the use of cement mortar and stone glue, thus free of secondary contamination to the stone; a dismountable concept enables the stone to be repeatedly utilized, which realizes resource recycle and is more environment-friendly and economic. The present invention is novel, safe, effective, low cost, implementing green mounting, environment-friendly and economical, and is suitable for various indoor and outdoor decoration users to use widely.

The architectural decoration panel of the present invention may be granite, marble, artificial stone or other stone product.

In other embodiment, the architectural decoration panel component can be replaced by other materials, which are also equivalent technical solutions of the present invention, for example, the stone in the stone component may be replaced by other materials, or the composite of the stone and the glass-magnesium composite material backing layer in the stone component may be entirely replaced by other materials, and the other materials here refer to: woods, ceramic tiles, glass, glass products, metal and nonmetal fire-proof building materials, and metal and nonmetal building materials or the like, which can be mounted on such surfaces like the external facade, internal facade, ceiling and floor of a building wall surface, and have a platy structure or a structure having shapes. The architectural decoration panel may either be a slab shape, or be a shape having bulge or depression. Panels of different materials may be flexibly mounted on the same wall surface.

In other embodiment, the coupling assembly may also be replaced by other materials which have proper characteristics, such as intensity, and are also proper in price, for example, some composite materials or plastic pieces, which are also equivalent technical solutions of the present invention.

The invention claimed is:

1. An architectural decoration panel dry-hang structure free comprising:

a vertical keel frame, a transverse skeleton rectangle nut having a rectangular shape with two opposite curved surfaces at corners thereof disposed inside a mounting groove on the vertical keel frame, a transverse skeleton located on the outside of the vertical keel frame, the transverse skeleton having at least one transverse skeleton mounting groove, a transverse skeleton screw screwed into the transverse skeleton rectangle nut after traversing the transverse skeleton, wherein the transverse skeleton screw extends through a bottom of the transverse skeleton mounting groove so as to be screwed into the transverse skeleton nut disposed in the vertical keel frame mounting groove, and rotates to drive the transverse skeleton nut to rotate tightly to lean against a side wall of the vertical keel frame mounting groove to provide a frictional and supporting force between the vertical keel frame mounting groove and the transverse skeleton; and a coupling assembly disposed at the back of an architectural decoration panel component which is inserted in the transverse skeleton mounting groove so that the architectural decoration panel component is hung on the transverse skeleton.

2. The architectural decoration panel dry-hang structure according to claim 1, wherein the transverse skeleton mounting groove is a groove which is opened outward, and after the coupling assembly is inserted into the transverse skeleton mounting groove, a friction face on the surface of the coupling assembly tightly leans against a friction face on the side wall of the transverse skeleton mounting groove.

3. The architectural decoration panel dry-hang structure according to claim 2, wherein both the friction face on the surface of the coupling assembly and the friction face on the side wall of the transverse skeleton mounting groove are transverse strip-shaped threaded form structures.

4. The architectural decoration panel dry-hang structure according to claim 1, wherein the architectural decoration panel component comprises an architectural decoration panel, a composite material backing layer adhered to the architectural decoration panel, and the coupling assembly fixed on the composite material backing layer.

5. The architectural decoration panel dry-hang structure according to claim 4, wherein the composite material backing layer is provided with two chutes, two mounting plates of the coupling assembly are tightly inserted in the chutes so that the coupling assembly is fixed on the composite material backing layer.

6. The architectural decoration panel dry-hang structure according to claim 4, wherein the composite material backing layer is provided with a mounting groove, the mounting groove is provided with two parallel mounting faces, the coupling assembly having two parallel mounting faces is tightly inserted in the mounting groove so that the coupling assembly is fixed on the composite material backing layer.

7. The architectural decoration panel dry-hang structure according to claim 1, wherein a part of the coupling assembly coupled with the architectural decoration panel and a part of the coupling assembly coupled with the transverse skeleton mounting groove may be coupled in a relatively sliding manner in a form of clamping strip and clamping groove.

8. The architectural decoration panel dry-hang structure according to claim 1, wherein a part of the coupling assembly coupled with the architectural decoration panel and a part of the coupling assembly coupled with the transverse skeleton mounting groove may be coupled in a relatively rotating manner in a form of rotating shaft.

9. The architectural decoration panel dry-hang structure according to claim 1, wherein two parallel vertical keel frame mounting grooves are disposed on the vertical keel frame, and are corresponding to the transverse skeletons mounted at the two sides of the vertical keel frame respectively.

* * * * *